51-298 SP
10/15/85 OR 4,547,204

United States Patent [19]
Caul

[11] Patent Number: 4,547,204
[45] Date of Patent: Oct. 15, 1985

[54] RESIN SYSTEMS FOR HIGH ENERGY ELECTRON CURABLE RESIN COATED WEBS

[75] Inventor: Lawrence D. Caul, Buffalo, N.Y.

[73] Assignee: Carborundum Abrasives Company, Niagara Falls, N.Y.

[21] Appl. No.: 617,686

[22] Filed: Jun. 6, 1984

Related U.S. Application Data

[62] Division of Ser. No. 195,030, Oct. 8, 1980, Pat. No. 4,457,766.

[51] Int. Cl.[4] ..... C09K 3/14
[52] U.S. Cl. ..... 51/298; 427/44
[58] Field of Search ..... 51/298; 427/44

[56] References Cited

U.S. PATENT DOCUMENTS

| | | | |
|---|---|---|---|
| 2,824,851 | 2/1958 | Hall | 525/531 |
| 3,101,276 | 8/1963 | Hendricks | 117/56 |
| 3,806,327 | 4/1974 | Farmer et al. | 51/295 |
| 4,011,063 | 3/1977 | Johnston | 51/295 |
| 4,047,903 | 9/1977 | Hesse et al. | 51/298 |
| 4,072,592 | 2/1978 | Due et al. | 204/159.15 |
| 4,082,634 | 4/1978 | Chang | 204/159.15 |
| 4,107,125 | 8/1978 | Lovejoy | 51/298 |
| 4,129,489 | 12/1978 | Christenson et al. | 204/159.15 |
| 4,133,909 | 1/1979 | Spencer | 427/54.1 |
| 4,142,870 | 3/1979 | Lovejoy | 51/298 |
| 4,177,310 | 12/1979 | Steeves | 428/216 |
| 4,177,314 | 12/1979 | Steeves | 428/336 |

*Primary Examiner*—Paul Lieberman
*Assistant Examiner*—Willie Thompson
*Attorney, Agent, or Firm*—Michael L. Dunn; Donald C. Studley

[57] ABSTRACT

The invention provides resin compositions which are particularly suitable for utilization in electron cured coated abrasives. The resin systems of the instant invention have been devised to be particularly suitable for the backing fill of a cloth which is to form the base of a coated abrasive. The formation of a treated base cloth for coated abrasive formation by electron beam curing resins creates a product which in addition to being suitable for immediate formation into a coated abrasive by application of grain is further a product which may be stored for later use or sold to other parties that have need for a waterproof stretch-resistant cloth or that make coated abrasives without doing cloth finishing. The invention also encompasses the formation of electron curing resin systems which are particularly desirable for the make coat and size coat utilized in forming coated abrasives. It is within the system of the invention to utilize the electron radiation curing resins in combination with the conventional heat curing resins.

11 Claims, 2 Drawing Figures

RESIN SYSTEMS FOR HIGH ENERGY ELECTRON CURABLE RESIN COATED WEBS

This is a division of application Ser. No. 195,030 filed Oct. 8, 1980, now U.S. Pat. No. 4,457,766.

BACKGROUND OF THE INVENTION

1. Field of the Invention

The invention relates to coated abrasives formation. The invention particularly relates to materials and methods for the formation of coated abrasive materials and the curing of backing coats on cloth or paper which will be used for formation of coated abrasives.

2. Prior Practices

It is known in the coated abrasive art to apply resinous binder and abrasive grains to a paper or cloth substrate which is cured yielding sufficient strength for the following applications, subsequently the size coat is applied and the product completely cured. Suitable binders are for example glutelin glue, phenolic resins and, if water-proof papers are desired, polyurethane resins, epoxy resins and alkyd resins, possibly in combination with melamine resins. Special requirements as related to technique, apparatus and time are necessary for the curing process. To avoid destruction of the substrates usually consisting of polyester or cellulose, curing should be effected at a maximum temperature of 120° to 130° C. Rapid curing allowing for the use of a horizontal dryer is difficult, because of the formation of gas bubbles affecting the adhesion of the resin on the substrate. Drying of the coated material generally requires one or several hours, and is therefore carried out in a loop dryer. The loop dryers through which the coated web material is passing, enable a long drying process, but there are also disadvantages, such as the formation of defects where the material is suspended, sagging of the binder and changing of the grain position due to the vertical suspension, variation of temperature and the resulting inconsistent crosslinking of the binder produced by the necessary slow air circulation.

There are several disadvantages of the predominant commercial practice of forming coated abrasives. There are several curing steps in the typical process for formation of cloth-backed abrasives. The major areas of production may be considered as first the cloth treatment to prepare the base cloth for application of abrasives and second the making of the coated abrasives using the previously prepared base cloth. The base cloth is coated with at least one backing coat of resin which impregnates the cloth with resin and fills interstices in the back of the cloth. The backing cloth is also coated with at least one face coat that fills interstices of the cloth on the side where abrasive grain is placed. The face coat or coats of the backing cloth also aid in adhesion of the coat containing the grains onto the cloth.

The second major area of coated abrasive drying is the drying of the make coat which contains the grain and curing the size coat which is an overcoat placed onto the coated abrasive after the grain is at least partially adhered onto the backing by the make coat. In some instances, pre-size coat(s) are applied prior to the make coat. The drying of the presize make and size coats as set forth above generally is done in a lengthy loop dryer that requires a tremendous amount of floor space and energy. Further the larger dryers where the curing takes place over a long period are difficult to completely control for accurate temperature. There also is the problem of the resin and grain shifting positions during curing because of the long hang times in the uncured form.

It has been suggested in the U.S. Pat. No. 4,047,903, Hesse et al, that the formation of coated abrasives be carried out with at least one layer of resin being cured by electron beam. However, there has remained a need for apparatus which would allow the commercial exploitation of electron beam curing. Hesse et al does not set forth apparatus that would allow the continuous formation of coated abrasives. There are extensive difficulties in commercial exploitation of electron beam curing. Selection of resins suitable for electron beam curing of all resin coats utilized in formation of coated abrasives is difficult.

When forming coated abrasives, normally relatively thick coats of resin compared with prior uses of the electron beam are utilized. The resins necessary also are very sticky prior to being completely cured. Therefore, multiple path systems such as disclosed in some prior electron beam curing systems such as U.S. Pat. No. 3,022,543 are not satisfactory since if the resins touch a roller the system usually will gum-up and not perform.

Therefore, there remains a need for a system of electron beam curing resins which will allow formation of good quality coated abrasives in a low-cost commercially satisfactory manner.

BRIEF DESCRIPTION OF THE INVENTION

It is an object of this invention to overcome disadvantages of the prior methods for forming resin coated webs of paper and cloth.

It is a further object of this invention to overcome disadvantages of the prior methods for forming coated abrasives.

It is an additional object of this invention to provide electron beam curable resins for back coats on cloth for use in coated abrasives formation.

It is another further object of this invention to provide improved face coats on cloth for use in coated abrasive formation with electron beam curing.

It is another further object of this invention to provide improved make coats for use in forming electron beam curable coated abrasives.

It is another further object of this invention to provide a system of electron beam curing in a continuous manner for coated cloth and coated abrasive materials.

It is an additional further object of the invention to provide improved continuous uniform coating of backing materials for coated abrasives.

It is an additional object of this invention to provide electron beam curing resin systems with good adhesion to backing materials.

It is a further object of the invention to provide an improved resin system for electron beam curing of the size coat for coated abrasives.

It is again another object of this invention to provide resin systems suitable for continuous make-coating and abrasive grain application to webs in apparatus for electron beam curing in the formation of coated abrasives.

It is another object of this invention to provide uniform continuous coated abrasive materials.

These and other objects of the invention are generally accomplished by providing resin compositions which are particularly suitable for utilization in electron cured coated abrasives. The resin systems of the instant invention have been devised to be particularly suitable for the backing fill of a cloth which is to form the base of a coated abrasive. The formation of a treated base cloth for coated abrasive formation by electron beam curing resins creates a product which in addition to being suitable for immediate formation into a coated abrasive by application of grain is further a product which may be stored for later use or sold to other parties that have need for a waterproof stretch-resistant cloth or that make coated abrasives without doing cloth finishing.

The invention also encompasses the formation of electron curing resin systems which are particularly desirable for the make coat utilized in forming coated abrasives. The make coat is the resin coat onto which the abrasive grain is deposited. The make coat must be such as to hold the grain in the resin during use while the belt is flexed numerous times without the coat becoming dislodged from the base cloth or the grain becoming dislodged from the resin layer. Another feature of this invention is that a novel size coat resin system for high energy electron curing has been devised. The size coat is the coat which is placed over the grain of an abrasive to aid in holding the abrasive grains onto the base cloth during flexing and grinding operations.

It is within the system of the invention to utilize the electron radiation curing resins in combination with the conventional heat curing resins. For instance, the back and face coats of the cloth could be formed by electron beam curing and then the make and size coats formed utilizing conventional resin systems. In addition, the electron beam curing resin systems of the instant invention could be utilized with a backing cloth having the conventional heat-cured resins.

DETAILED DESCRIPTION OF THE INVENTION

The resin systems of the instant invention provide advantages over prior systems. The electron radiation curing resin systems for the make and size coat of the coated abrasives provide more uniform resin coats and allow rapid curing with little time for shifting of the resin grain prior to cure. Further, the system is advantageous in a savings of space and labor required in performing the operations of coated abrasive manufacture. The treating of cloth, paper or like backing materials to prepare them for use as coated abrasives base or for use as a base for other coating processes.

The resin systems of the invention may be utilized to form either cloth-backed or paper-backed resin treated sheet materials. The resin systems further may be used to provide resin-treated flexible webs of cloth or paper that may be sold for others to use in coated abrasive manufacture.

Figure 1:
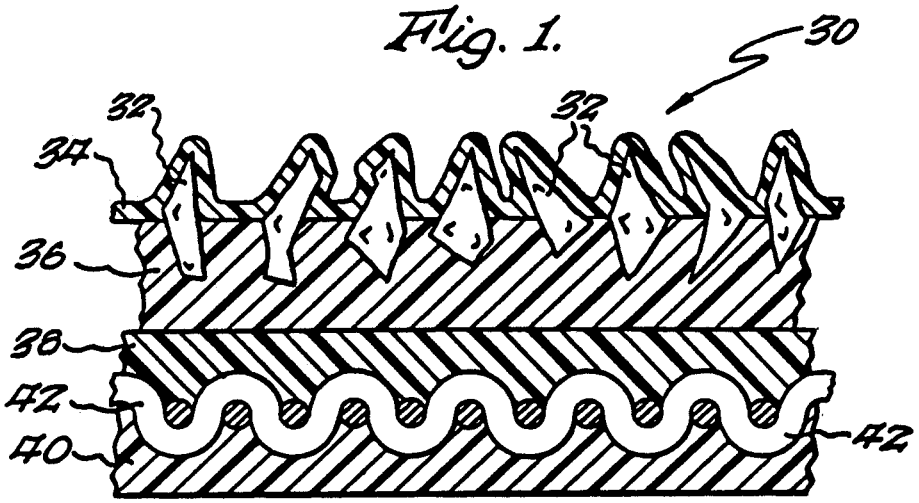
FIG. 1 illustrates in cross-section the formation of a coated abrasive on a cloth backing material.
Figure 2:
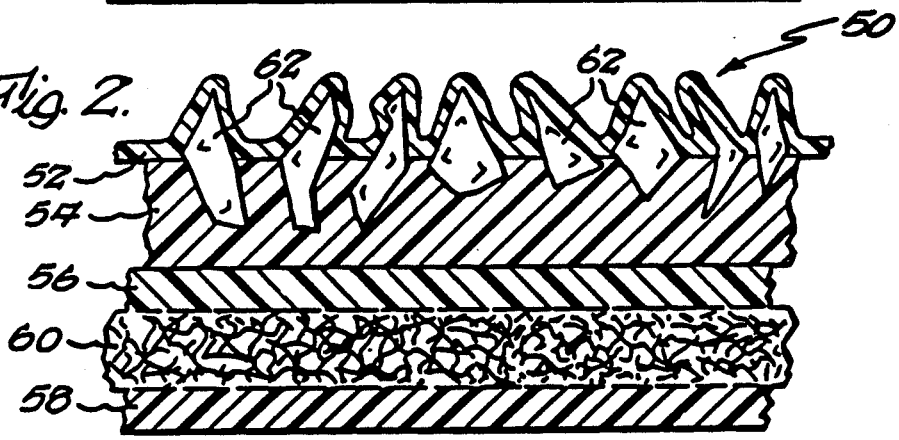
FIG. 2 is a sectional view of a coated abrasive on a paper-backing material.

Coated abrasives such as may be produced by resin systems of the invention are illustrated in cross-section in FIGS. 1 and 2. As illustrated in FIG. 1, the coated abrasive generally indicated as 30 is cloth backed. Cloth 42 has been treated with a back coat 40 and a face coat 38. Overlaying the face coat is a make coat 36 in which are embedded abrasives 32 such as silicon carbide and aluminum oxide. A size coat 34 has been placed over the make coat 36 and the abrasive grains 32. There is no clear line of demarcation between the back coat and the face coat which meet in the interior of the cloth backing which is saturated as much as possible with the resins of these coats.

In FIG. 2 there is illustrated a coated abrasive generally indicated as 50 which is formed on a paper backing 60. Paper backing 60 is treated with a back coat 58 and a face coat 56. The face coat is overcoated with a make coat 54 in which are embedded abrasive grains 62. The abrasive grains 62 and make coat 54 are overcoated with a size coat 52 which aids in holding the abrasive grains 62 onto the backing during utilization and further may contain cutting aids. The order in which the back coat and face coat are placed onto the substrate may be varied, but generally the face coat is placed onto the substrate first. Each of the back coat, face coat, make coat and size coat is cured prior to being overcoated with additional resin systems.

The electron radiation curable resin systems of the invention generally in each case comprise an oligomer, a diluent, fillers and minor amounts of other additives, such as surfactants, pigments and suspending agents. The amounts and specific material are selected in each case to give the desired properties and lowest cost for each coat.

The oligomers used in the systems of the invention may be any reactive polymer which gives the desired properties to the backing material and coated abrasive materials. Suitable electron-curable materials have been found to be the urethane-acrylates, and epoxy-acrylates. Particularly preferred among the acrylated epoxies are the diacrylate esters such as the diacrylate esters of bisphenol A epoxy resin. Preferred urethanes are diacrylate esters of a hydroxy terminated NCO extended polyesters or polyethers, as these resins have good strength properties and adhere well to both the base materials and the abrasive grain. The urethane-acrylates find best use in cloth treatment systems and waterproof cloth make coat as they are less hard than the epoxy acrylates.

In addition to the oligomers, diluents are utilized. The diluents are utilized to adjust the viscosity so as to be suitable for the various application methods such as knife coating, roll pressure coating, transfer rolls and doctor blades. Further, the diluents modify curing properties and modify the flexibility of the resin to increase or decrease flexibility for use in the coated abrasives. Any diluent suitable for advantageously modifying the properties of acrylated urethane or acrylated epoxy resins may be utilized in the invention. Among suitable diluents for the electron-curable resins are the vinyl pyrrolidones and the multi-functional and monofunctional acrylates. The preferred compounds are N-vinyl-2-pyrrolidone (NVP), 1, 6 hexanediol diacrylate (HDODA), tetraethylene glycol diacrylate (TTEGDA) and trimethylolpropane triacrylate (TMPTA) as these materials have been found in addition to adjusting viscosity successfully, control flexibility and reduce radiation required for curing.

The resin systems of the invention also generally contains a filler material which may be selected from any filler which does not harmfully effect the properties of the system, is low in cost and is able to be included in significant amounts in the system. Preferred fillers are calcium carbonate, aluminum silicate and aluminum trihydrate as these materials have been found to be usable in large amounts in the resin systems with retention of good property strengths and flexibility properties of the cured resin.

Among additives suitable for the resin systems of the instant invention are those designed to act as surfactants, pigments for colors and suspending agents. A preferred suspending agent has been found to be fumed silica, preferably in about 12 millimicron particle size, as much material gives good rheological properties. Any suitable dyes or pigments may be utilized to color the coated abrasive by the desired amount.

In formation of both the face and back coats of the invention, the oligomer and diluent are mixed in a ratio of about 50 to about 90% oligomer to about 10 to about 50% diluent. A preferred range of diluent has been found to be about 10 to about 30% by weight of the oligomer for desired flexibility and hardness. The amount is selected so as to give the desired viscosity for application of the oligomer by whatever method of application is utilized and also to give the required flexibility and hardness.

The amount of filler in the face and back coat is determined in respect to the mixture of oligomer and diluent. Generally between about 30 and about 100 parts by weight of filler are utilized per 100 parts by weight of the oligomer and diluent system. The surfactant, suspending agent and pigments are generally used in very small amounts and at the minimum which is effective to give the colorant and dispersant properties desired.

The amount of face fill necessary for each substrate is best determined by looking to the properties desired in the final product. In the instance of 17 pound per ream polyester substrate, it has been found that between about 25% and about 60% of the fabric weight should be applied as a face fill coat. For the same 17 pound polyester fabric, a back fill of about 10% to about 30% by weight of the polyester has been found to be suitable to produce a filled cloth of excellent flexibility, wear and stretch resistance.

The amount of the make and size coats applied to the substrate is whatever is sufficient to hold the abrasive particles.

The methods of applying the coatings of the invention may be selected from those conventional in the coated abrasive art. Among typical methods are roll coating from a transfer roll and doctor blade coating. A preferred method has been found to be press roll or direct roll coating as this is easy to control.

In the size coat, active fillers may be utilized that aid in cutting. Among such fillers for utilization in the size coat are cryolite cutting aids which increase the life of the abrasive. Typical other cutting aids are potassium fluroborate, feldspar, sulfur and iron pyrites.

The amount of radiation from an electron radiation source utilized to cure the instant resin systems is selected to provide complete cure. First coats may not need complete cure. A cure of the back end face coats at 300 kilovolts for a 1 megarad dose to provide sufficient cure with application of the radiation directly onto the wet surface. The make and size coats for the resin systems of the invention at the about 20 mils thickness utilized have been found to be sufficiently cured at 500 kilovolts for a 5 megarads dose from either the face or through the backing. The total voltage requirement is regulated to vary the depth of penetration of the electron beam or other electron radiation source.

The resin systems of the instant invention may be utilized for coating with any suitable source of electron radiation and coating apparatus. A suitable apparatus is disclosed in copending and coassigned application entitled APPARATUS FOR ELECTRON CURING OR RESIN COATED WEBS, inventor Alton Miller, filed as Ser. No. 172,722 on July 28, 1980.

The following examples illustrate the formation of a coated abrasive in accordance with preferred forms of the instant invention. Parts and percentages are by weight unless otherwise indicated. A ream as utilized in the description and Examples is 480 sheets of 9 inches by 11 inches.

EXAMPLES

EXAMPLE 1

This Example will illustrate the formation of a coated abrasive utilizing the EB cured resins of the invention in each coat of the abrasive and backing material.

There is provided a sateen polyester cloth in a weave of 103×40. This means that there are 103 threads per inch in the running direction and 40 threads per inch in the crossing direction. The polyester had been heat treated to provide a fabric with very low shrink and stretch properties.

A face fill coating was applied to the cloth side with the predominance of fill threads. The face fill ingredients were as follows:

| CLASS | COMPOSITION | AMOUNT |
|---|---|---|
| Oligomer | Acrylated-urethane (Uvithane ® 783 Thikol Corporation) | 4064 grams |
| Diluent | N—vinyl-2-pyrrolidone | 3800 grams |
| Filler | calcium carbonate of specific gravity of about 2.74 with an average particle size of between about 17 and about 25 microns as measured at the 50% point on a sedimentation curve. Not over 35% by weight remaining on a 270 mesh screen having an opening of 53 microns. | 3600 grams |
| Surfactant | ethoxylated alkyphenol (Igepal ® surfactant GAF Corporation) | 56 grams |
| Suspending agent | fumed silica (Aerosil 200) | 60 grams |
| Colorant | red pigment (P.D.I. 1501) Pigment Dispersions Inc. | 10 grams |

The face fill coating was applied to a continuous polyester material of 17 pounds per ream weight as set forth above by a knife at a rate of about 11 pounds per ream in a continuous coating and electron beam curing device such as illustrated in the above-referenced copending application Ser. No. 172,722 filed July 28, 1980, entitled APPARATUS FOR ELECTRON CURING OF RESIN COATED WEBS, which has been incorporated by reference. The layer is partially cured to a non-tacky state at about 300 kilovolts at a speed of about 20 feet per minute for a magarad dose of 0.8 megarads.

After the face fill was partially cured, the cloth having the cured face fill coat was repositioned for application of a back fill coat. The back filled coat had a radiation curable resin system coating as follows:

| CLASS | COMPOSITION | AMOUNT |
|---|---|---|
| Oligomer | diacrylate ester of a bisphenol A type epoxy resin (Celrad ® 3600 Celanese Chemical Co.) | 2000 grams |
| Diluent | N—vinyl-2-pyrrolidone | 2000 grams |
| | trimethylolpropane triacrylate (TMPTA) | 780 grams |
| Filler | calcium carbonate (same as in face fill) | 5000 grams |
| Surfactant | FC430 (Florocarbon from | 10 grams |

-continued

| CLASS | COMPOSITION | AMOUNT |
|---|---|---|
| | 3M Company) | |
| Colorants | brown (PDI 1705) | 500 grams |
| | black (PDI 1800) from Pigment Dispersions Inc. | 50 grams |
| Suspending Agent | fumed silica, Aerosil 200, average primary particle size 12 millimicron | 100 grams |

This resin system was roll coated by direct roll application onto the back of the previously face filled roll. The application rate was at a rate of about 5 pounds per ream. The coating was then cured at 300 kilovolts at a speed of 20 feet per minute for an exposure of about 0.8 megarads. After curing, the back and face coated cloth was removed and again placed in the device as the dispensing roll.

A make coat was prepared for application to the prepared backing material. The make coat has the following composition:

| CLASS | COMPOSITION | AMOUNT |
|---|---|---|
| Oligomer | acrylated epoxy resin (Celrad ® 3500 - Celanese Chemical Co.) | 5530 grams |
| Diluents | N—vinyl-2-pyrrolidone | 1273 grams |
| | isobornyl acrylate available from Rohm and Haas Company as Monomer QM-589 | 1661 grams |
| | acrylic acid | 288 grams |
| Filler | calcium carbonate (same composition as in the face fill coat) | 4000 grams |
| Surfactant | FC-430 fluorocarbon | 10 grams |
| Suspending agent | Aerosil 200 | 150 grams |
| Colorants | red pigment (P.D.I. 1501 Pigment Dispersions, Inc.) | 270 grams |

The make coat was applied at a rate of about 15.7 pounds per ream at an application speed of about 20 feet per minute. The grain was applied at a rate of about 72 pounds per ream using alumina grain of particle size 36 grit. The curing was carried out at 500 kilovolts to give a treatment of about 5 megarads. Cure was carried out by electron beam through the backing rather than directly onto the grain. The backing having the make coat and abrasive grain thereon was removed and placed in position for application of the size coat.

The size coat of the following composition was prepared for application onto the make coat and grain.

| CLASS | COMPOSITION | AMOUNT |
|---|---|---|
| Oligomer | Celrad ® 3600 (further identified in the back coat listing above) | 5210 grams |
| Diluent | isobornyl acrylate (further identified in the make coat listing above) | 1500 grams |
| | NVP (further identified in the face fill listing above) | 1500 grams |
| | TMPTA (further identified in the listing under back fill above) | 1000 grams |
| Filler | calcium carbonate (further identified in the face fill listing above) filler | |
| Cutting aid | cryolite (95% through 325 U.S. mesh screen all through 100 U.S. mesh) | 8000 grams |
| Suspending agent | Aerosil 200 | 100 grams |

-continued

| CLASS | COMPOSITION | AMOUNT |
|---|---|---|
| Pigment | black pigment (Pigment Dispersion Inc. P.D.I. 1800) | 100 grams |

The size coat was cured at 500 kilovolts at a speed of approximately 20 feet per minute past the electron beam. The curing dose was about 5 megarads dose from the face side.

The abrasive material was tested and found to provide coating performance at least equal to the presently available alumina abrasives formed on the same polyester backing material.

EXAMPLE 2

The polyester backing material having a face fill and back fill coat as formed in Example 1 is utilized to form a coated abrasive utilizing conventional waterproof heat curable make and size coats. The make coat is of the composition:

| CLASS | COMPOSITION | AMOUNT |
|---|---|---|
| Phenolic Resin | Phenol-formaldehyde resole 550 cps. at 70% solids | 10,000 grams |
| Filler | Calcium carbonate (same as Example 1) | 10,000 grams |
| The size coat is of a conventional heat curing resin: | | |
| Phenolic Resin | Phenol-formaldehyde resole 500 cps. at 70% solids | 8,100 grams |
| Cutting Aid | Cryolite (same as Example 1) | 9,900 grams |
| Pigment | Carbon black dispersion | 100 grams |

This product exhibits good coated abrasive properties, comparable with the conventional products.

EXAMPLE 3

The process of Example 1 was repeated except that the back fill coat was formed utilizing a conventional heat curable acrylic latex resin formed of 70 parts of heat curable latex (Rohm & Haas AC 604—46% latex solids) and 30 parts calcium carbonate (same composition as Example 1).

The product was a satisfactory coated abrasive with good cutting and life properties.

EXAMPLE 4

The process of Example 1 was repeated except that a heat curing make coat of phenolic resin composition below was substituted for the electron beam curable coat of Example 1.

| CLASS | COMPOSITION | AMOUNT |
|---|---|---|
| Phenolic Resin | Phenol-formaldehyde resole 550 cps. at 70% solids | 10,000 grams |
| Filler | Calcium carbonate (same as Example 1) | 10,000 grams |

A satisfactory coated abrasive was produced.

EXAMPLE 5

The Example of Example 1 was repeated except that a heat curing size coat composition as below was substituted for the electron beam curing size coat of Example 1.

| CLASS | COMPOSITION | AMOUNT |
|---|---|---|
| Phenolic Resin | Phenol-formaldehyde resole 500 cps. at 70% solids | 8,100 grams |
| Cutting Aid | Cryolite (same as Example 1) | 9,900 grams |
| Pigment | Carbon black dispersion | 100 grams |

A satisfactory coated abrasive material was produced.

It is understood that the above-described embodiments are simply illustrative of the invention and that many other embodiments can be devised without departing from the spirit and scope of the invention. For instance, the amount of the electron radiation curing resins applied to the coated abrasive material may be changed depending on the backing material and intended use of the abrasive. Further, while the invention has been illustrated with specific acrylated-urethane and acrylated epoxy resins as the oligomers, there are numerous other acrylated epoxies and electron beam curing acrylated-urethanes which could be utilized in the instant invention. Further, while the diluents have been illustrated as acrylates of specific composition, there are other acrylates which could be utilized if desired to give polymers or different hardness. Although, the resin systems of the invention have been found to be particularly suitable for use in combination with each other, the systems of the invention may be utilized in combination with conventionally cured coatings or with other electron beam cured coatings. Further, other additives could be inserted into the system without detrimentally affecting the invention. For instance, viscosity controlling agents, anti-foaming agents or other colorants could be utilized. Further, it would be within the scope of the invention to in the instance of a base other than polyester, to utilize adhesion promoters with a particular substrate in the face, size and backing layers such as silanes materials to promote the adhesion to fiberglass backings.

While the invention has been described with specific embodiments, there are modifications that may be made without departing from the spirit of the invention. For instance, the method of coating could be changed to coat all layers as transfer roll or doctor roll. Further, another change within the invention would be to cure the coatings from either the wet resin side or application of the electron beam through the backing to cure the resin. Further, while the cloth treatment steps have been specifically illustrated by the use of the cloth material in coated abrasives, there are other uses of such materials such as in forming artificial leathers, waterproof fabrics for tents and boats and filled fabrics that are utilized for vapor barriers. The scope of the invention is not to be limited by specific illustrates, but is defined by the claims.

What is claimed is:

1. A coated abrasive having at least one each of a back, a base, a make and a size layer wherein at least one layer comprises an electron radiation curable resin system comprised of an urethane acrylate resin or epoxy acrylate resin, and at least one layer comprised of a heat curable phenolic resin, heat curable acrylate latex resin or mixture thereof.

2. The abrasive of claim 1 wherein at least one of said resin layers contains a surfactant.

3. The coated abrasive of claim 1 wherein at least one of said resin layers comprises a colorant.

4. The coated abrasive of claim 1 wherein radiation curing system further comprises a diluent, said diluent comprises an acrylic acid derivative.

5. The coated abrasive of claim 1 wherein radiation curing system further comprises a diluent, said diluent comprises a pyrrolidone derivative.

6. The coated abrasive of claim 1 wherein the backing of said coated abrasive comprises cotton cloth or waterproof paper.

7. The coated abrasive of claim 1 wherein said radiation curing resin system comprises an epoxy acrylate.

8. The coated abrasive of claim 1 wherein said radiation curing resin system comprises an acrylated urethane.

9. The coated abrasive of claim 1 wherein the backing of said coated abrasives comprises a polyester cloth.

10. The abrasive composition of claim 1 wherein the heat curable resin is phenolic resin.

11. The abrasive composition of claim 10 wherein the phenolic resin is a resole resin.

* * * * *